US010426998B1

(12) United States Patent
McRee

(10) Patent No.: US 10,426,998 B1
(45) Date of Patent: Oct. 1, 2019

(54) PORTABLE DEVICE FOR MOVEMENT AND RESISTANCE TRAINING OF THE LOWER EXTREMITIES

(71) Applicant: ARIZONA BOARD OF REGENTS ON BEHALF OF THE UNIVERSITY OF ARIZONA, Tucson, AZ (US)

(72) Inventor: Laura Dawn McRee, Tucson, AZ (US)

(73) Assignee: ARIZONA BOARD OF REGENTS ON BEHALF OF THE UNIVERSITY OF ARIZONA, Tucson, AZ (US)

( * ) Notice: Subject to any disclaimer, the term of this patent is extended or adjusted under 35 U.S.C. 154(b) by 168 days.

(21) Appl. No.: 15/674,114

(22) Filed: Aug. 10, 2017

Related U.S. Application Data

(63) Continuation-in-part of application No. 14/694,398, filed on Apr. 23, 2015, now abandoned.
(Continued)

(51) Int. Cl.
*A63B 23/04* (2006.01)
*A63B 24/00* (2006.01)
(Continued)

(52) U.S. Cl.
CPC ..... *A63B 23/04* (2013.01); *A63B 21/0407* (2013.01); *A63B 24/0062* (2013.01);
(Continued)

(58) Field of Classification Search
CPC .... A63B 5/00; A63B 5/08; A63B 5/11; A63B 2005/085; A63B 21/00058; A63B 21/00069; A63B 21/00072; A63B 21/00076; A63B 21/00178; A63B 21/00181; A63B 21/00185; A63B 21/002; A63B 21/0023; A63B 21/02; A63B 21/021; A63B 21/022; A63B 21/023; A63B 21/025; A63B 21/026; A63B 21/04;
(Continued)

(56) References Cited

U.S. PATENT DOCUMENTS 1,509,793 A 9/1924 Thompson
3,295,847 A * 1/1967 Matt, Sr. ..... A63B 22/16 482/128
(Continued)

FOREIGN PATENT DOCUMENTS

NL 1020134 C1 3/2002

OTHER PUBLICATIONS

International Search Report for PCT Application No. PCT/US18/46323 dated Dec. 21, 2018.

*Primary Examiner* — Gary D Urbiel Goldner
(74) *Attorney, Agent, or Firm* — Nguyen Tarbet

(57) ABSTRACT

A device for movement and resistance training of the lower extremities is disclosed which helps prevent muscle deconditioning and deep vein thrombosis from lack of movement resulting in venous stasis and potential development of blood clot formation. The device includes footpads with spring resistance and sensors that register the number of times the pads are depressed and the amount of force applied by a user to the footpads. Data from use of the device may be stored and provided as feedback to the user so the user can monitor progress in using the device.

16 Claims, 5 Drawing Sheets

Related U.S. Application Data

(60) Provisional application No. 61/984,643, filed on Apr. 25, 2014.

(51) Int. Cl.
*A63B 21/04* (2006.01)
*A63B 71/06* (2006.01)
*A63B 22/00* (2006.01)

(52) U.S. Cl.
CPC .. *A63B 71/0622* (2013.01); *A63B 2022/0097* (2013.01); *A63B 2220/17* (2013.01); *A63B 2220/56* (2013.01); *A63B 2220/833* (2013.01); *A63B 2225/50* (2013.01)

(58) Field of Classification Search
CPC ..... A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/0615; A63B 21/0616; A63B 21/0617; A63B 21/068; A63B 21/08; A63B 21/15; A63B 21/159; A63B 21/4027; A63B 21/4029; A63B 21/4031; A63B 21/4033; A63B 21/4035; A63B 21/4039; A63B 21/4041; A63B 21/4045; A63B 21/4047; A63B 21/4049; A63B 22/0015; A63B 22/0017; A63B 22/0023; A63B 22/0025; A63B 22/0046; A63B 22/0048; A63B 22/0056; A63B 22/0058; A63B 22/16; A63B 22/18; A63B 2022/0038; A63B 2022/0094; A63B 2022/0097; A63B 2022/185; A63B 23/035; A63B 23/03508; A63B 23/03516; A63B 23/03533; A63B 23/03541; A63B 23/04; A63B 23/08; A63B 23/085; A63B 23/10; A63B 24/0062; A63B 71/0054; A63B 71/0063; A63B 71/0072; A63B 71/0081; A63B 71/009; A63B 71/06; A63B 71/0619; A63B 71/0622; A63B 71/0686; A63B 2071/065; A63B 2220/17; A63B 2220/50; A63B 2220/56; A63B 2220/58; A63B 2220/80; A63B 2220/803; A63B 2220/83; A63B 2220/833; A63B 2225/09; A63B 2225/093; A63B 2225/50
See application file for complete search history.

(56) References Cited

U.S. PATENT DOCUMENTS

| | | | | | |
|---|---|---|---|---|---|
| 3,741,540 | A * | 6/1973 | Shimizu | A63B 22/0056 | 482/128 |
| 3,744,483 | A | 7/1973 | Picolin | | |
| 3,917,261 | A * | 11/1975 | Small | A61H 1/0266 | 482/79 |
| 4,422,635 | A | 12/1983 | Herod et al. | | |
| 4,669,722 | A | 6/1987 | Rangaswamy | | |
| 4,830,366 | A | 5/1989 | Ruden | | |
| 5,069,445 | A * | 12/1991 | Mai | A63B 23/085 | 482/30 |
| 5,127,892 | A | 7/1992 | Sawdon | | |
| 5,178,596 | A * | 1/1993 | McIntire | A63B 21/0552 | 482/122 |
| 5,267,923 | A * | 12/1993 | Piaget | A63B 21/0085 | 482/52 |
| 5,890,996 | A | 4/1999 | Frame et al. | | |
| 6,360,629 | B2 * | 3/2002 | Schambre | G05G 1/405 | 74/512 |
| 6,808,476 | B2 | 10/2004 | Zagone | | |
| 7,156,794 | B2 | 1/2007 | Hakooz | | |
| 7,364,534 | B2 | 4/2008 | Zoller et al. | | |
| 7,481,751 | B1 * | 1/2009 | Arnold | A63B 21/023 | 482/121 |
| 8,430,796 | B1 | 4/2013 | Tarkington et al. | | |
| 9,687,401 | B2 | 6/2017 | Alford et al. | | |
| 2002/0165069 | A1 * | 11/2002 | Ravikumar | A63B 23/10 | 482/80 |
| 2003/0013582 | A1 | 1/2003 | Anderson et al. | | |
| 2005/0014609 | A1 | 1/2005 | Neff | | |
| 2007/0197345 | A1 | 8/2007 | Wallace et al. | | |
| 2007/0265146 | A1 | 11/2007 | Kowalczewski et al. | | |
| 2008/0146421 | A1 * | 6/2008 | Hsieh | A63B 21/02 | 482/129 |
| 2009/0163325 | A1 * | 6/2009 | Piaget | A63B 21/0085 | 482/53 |
| 2009/0212609 | A1 | 8/2009 | Mattedi et al. | | |
| 2011/0045955 | A1 | 2/2011 | Savane | | |
| 2011/0111927 | A1 * | 5/2011 | Kim | A63B 21/00192 | 482/52 |
| 2015/0119205 | A1 * | 4/2015 | Gillis | A63B 23/08 | 482/80 |
| 2015/0290061 | A1 * | 10/2015 | Stafford | A63B 71/0619 | 5/600 |

* cited by examiner

PORTABLE DEVICE FOR MOVEMENT AND RESISTANCE TRAINING OF THE LOWER EXTREMITIES

CROSS-REFERENCE TO RELATED APPLICATIONS

This application is a continuation-in-part and claims benefit of U.S. patent application Ser. No. 14/694,398 filed on Apr. 23, 2015, which claims benefit of U.S. Provisional Application No. 61/984,643, filed Apr. 25, 2014, the specification(s) of which is/are incorporated herein in their entirety by reference.

FIELD OF INVENTION

The present invention relates to exercise equipment, more specifically to a portable device for movement and resistance training of the lower extremities.

BACKGROUND

Prolonged bed rest or lack of movement of the lower extremities, especially among the elderly, result in a deconditioning of leg muscles that may contribute to deep vein thrombosis. Conventional prevention devices do not require participation of the individual. Other forms of prevention for deep vein thrombosis use medication, which may have many side effects. Hence, there is a need for a device that can help prevent leg maladies from neglect of leg exercise.

SUMMARY

According to one embodiment of the present invention, a device for movement and resistance training of the lower extremities comprises a support base; a footpad attached to the support base; a resistance mechanism attached to the footpad to resist pressure applied by a user's foot to the footpad; and one or more sensors attached to the footpad, the one or more sensors configured to detect an amount of pressure applied by the user's foot and a number of presses by the user. In some embodiments, the device may be electronically capable of tracking use and level of resistance for a user The currently existing systems and methodologies have inherent limitations and as such cannot deliver an exercise apparatus having a mechanical resistance providing an equal distribution of resistance to an engaged footpad for a more effective training of the lower extremities. The present invention is capable of providing this key function because of the arrangement of elements comprising the mechanical resistance mechanism attached to the engaged footpad as follows:

- a curved arm having a first end and a second end, the first end of the curved arm attached to an upper end of the footpad;
- a spring hinge mounted to a bracket secured to the support base;

the second end of the curved arm attached to the bracket; where the resistance of the spring hinge may determine the resistance experienced by the user via the footpad. For instance, Zagone (U.S. Pat. No. 6,808,476 B2) discloses an exercise apparatus defined by hinged first and second plates with a spring disposed therebetween for biasing resistance. One skilled in the art may appreciate that Zagone's mechanical resistance mechanism (i.e. the spring) provides a concentrated resistance to the base of the apparatus, where said resistance decreases proportional to the distance traveled away from the base. This configuration therefore delivers a reduced resistance to the upper part of a user's foot (compared to the mid and lower parts of the user's foot). Also, a user engaging Zagone's apparatus employs a static heel while the remainder of the foot applies force to push the first plate down.

Additionally, the present invention features a footpad having a curved shape, such that the curve formed from the upper end of the footpad to the lower end of the footpad is convex. Further, the curve formed from the leftmost border of the footpad to the rightmost border is either straight or convex. This geometry provides a contour that accommodates the natural shape of human feet, which, in turn, aides the user in comfortably applying an equal distribution of pressure to the footpad. In stark contrast, Hakooz (U.S. Pat. No. 7,156,794 B2) discloses a saddle-shaped footpad that extends upwardly from the center. This design defines a contour that is directly adverse to the natural contour of human feet.

BRIEF DESCRIPTION OF THE FIGURES

The detailed description of some embodiments of the present invention is made below with reference to the accompanying figures, wherein like numerals represent corresponding parts of the figures.

DETAILED DESCRIPTION OF CERTAIN EMBODIMENTS

Figure 1:
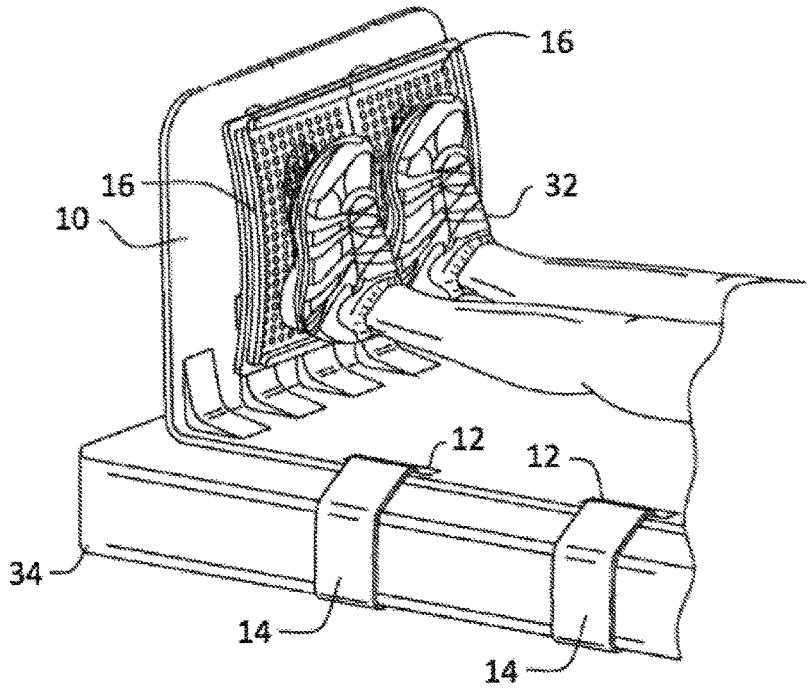
FIG. 1 is a perspective view of a device for movement and resistance training of the lower extremities in use in accordance with an exemplary embodiment of the subject technology.
Figure 2:
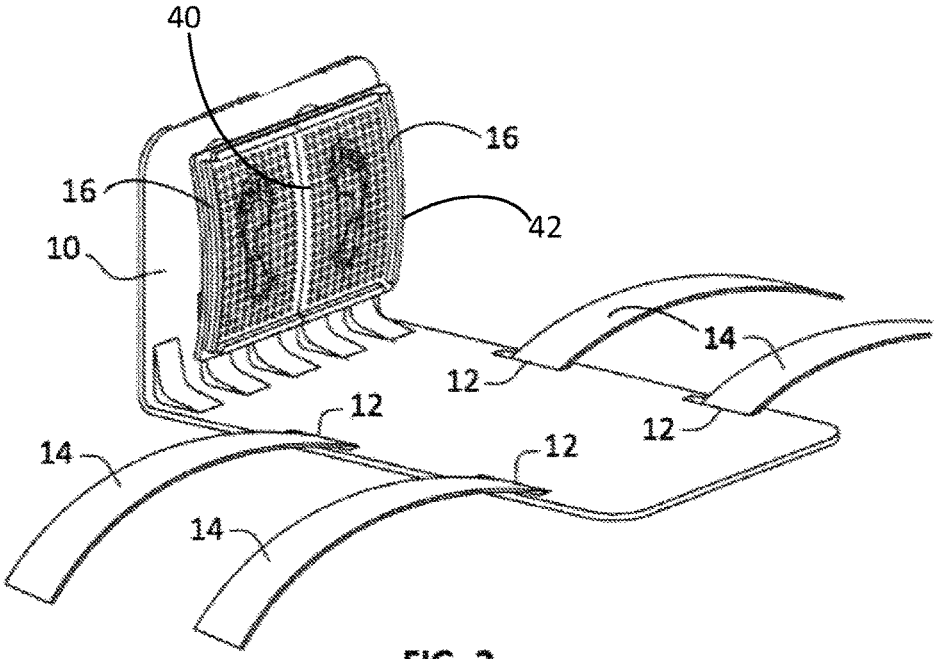
FIG. 2 is a perspective view of the device of FIG. 1.
Figure 3:
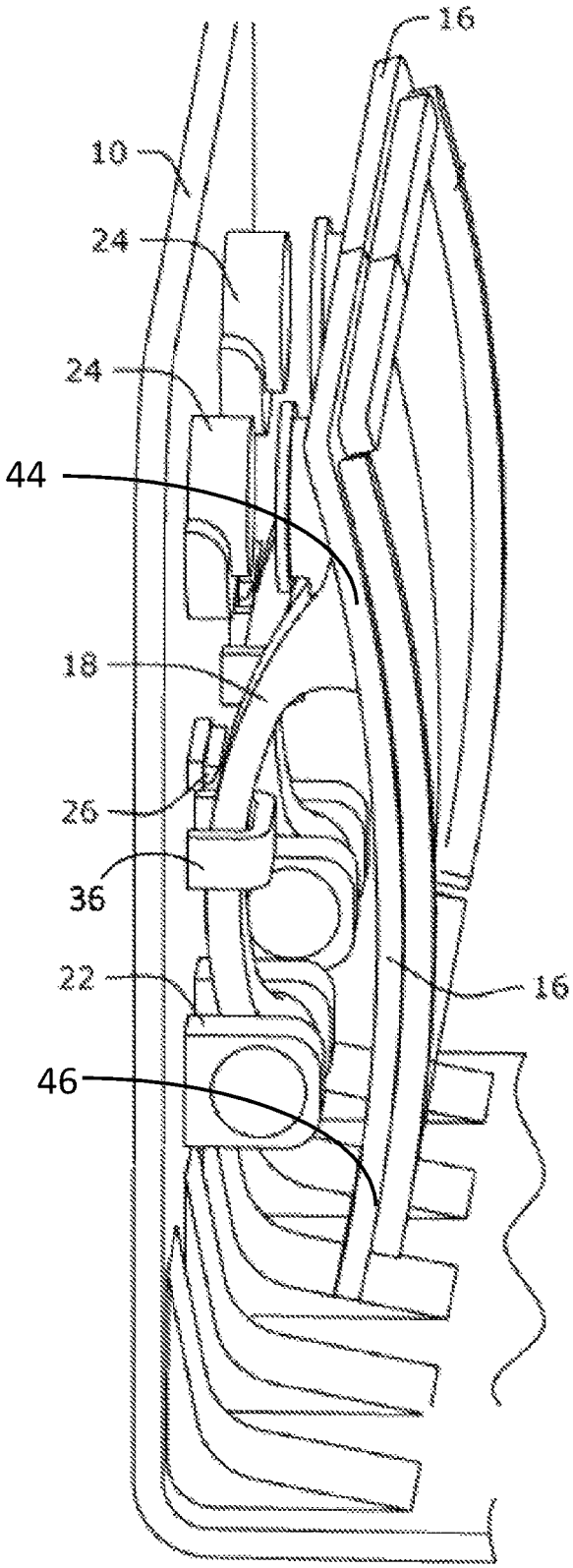
FIG. 3 is a side perspective view of the device of FIG. 1 in a default state with footpads removed.
Figure 4:
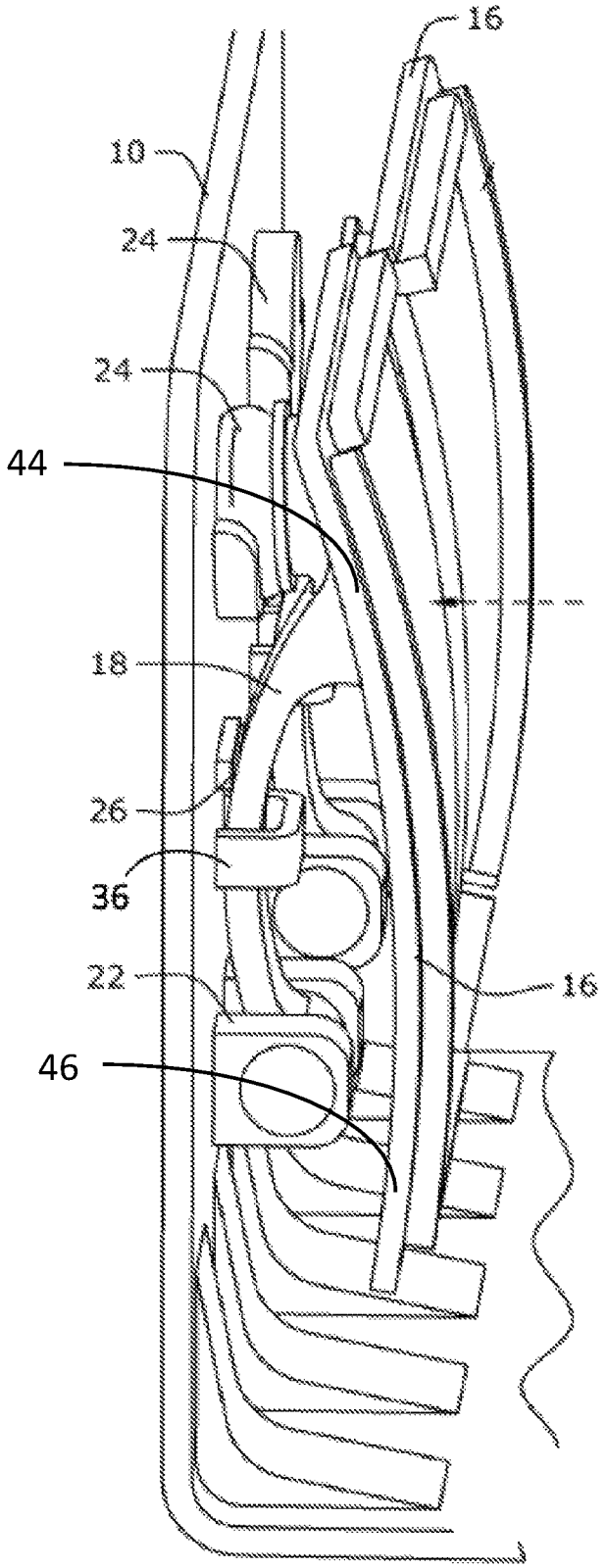
FIG. 4 is a side perspective view of the device of FIG. 3 moved into a partially engaged state.

The word "exemplary" is used herein to mean "serving as an example or illustration." Any aspect or design described herein as "exemplary" is not necessarily to be construed as preferred or advantageous over other aspects or designs.

By way of example, and referring to FIGS. 1-4, an embodiment of the subject technology comprises a support base 10, a footpad 16 attached to the support base 10, a resistance mechanism attached to the footpad 16 to resist pressure applied by the foot 32 of a user to the footpad 16, and sensors 24 and 26 attached to the footpad 16. In some embodiments, the curved shape of the footpad 16 is a convex curve from the upper end 44 of the footpad 16 to the lower end 46 of the footpad 16. In further embodiments, the curved shape of the footpad 16 is either straight or a convex curve from a leftmost border 40 of the footpad 16 to a rightmost border 42 of the footpad 16.

In additional embodiments, the resistance mechanism may comprise a curved arm 18 having a first end and a second end. The first end of the curved arm 18 may be attached near the upper end 44 of the footpad 16. In a non-limiting example, the first end of the curved arm 18 may be joined to the upper end 44 of the footpad 16 via an adhering substance or component. In an embodiment, the first end of the curved arm is disposed between the upper end 44 of the footpad 16 and a middle portion of the footpad 16.

Figure 7:
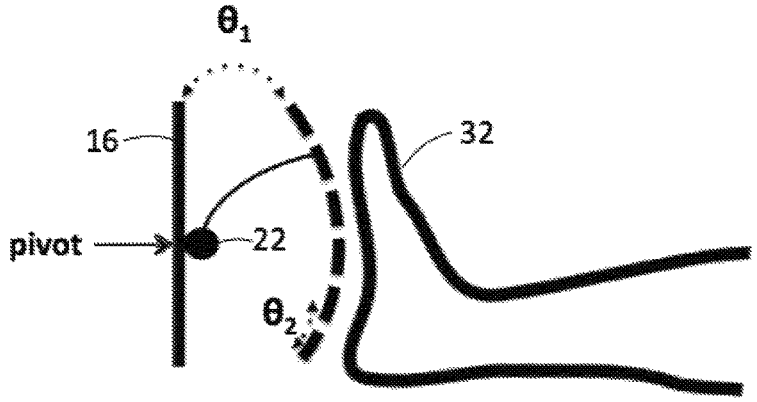
FIG. 7 is a perspective view of the device of FIG. 1 highlighting example ranges of motion, $\theta_1$ and $\theta_2$, of said device.

A spring hinge, mounted to a bracket 22 secured to the support base 10, may also comprise the resistance mechanism. In further embodiments, the second end of the curved arm 18 may be attached to the bracket 22 via the spring hinge. The resistance of the spring hinge may determine the resistance experienced by the foot 32 of the user via the footpad 16. Moreover, the bracket 22 may further function to provide a pivot point about which the foot 32 of the user may move. As detailed in FIG. 7, during operation of the device, the entire foot 32 of the user is in motion. As a non-limiting example, the upper end 44 of the footpad 16 may traverse path $\theta_1$, while the user's foot 32 (from heel to toe) may traverse path $\theta_2$. This unique arrangement of elements comprising the resistance mechanism provides an equal distribution of resistance to the footpad 16 for a more effective training of the user's foot 32.

In further embodiments, a brace 36 directly coupling the curved arm 18 to the support base 10 may also comprise the resistance mechanism; such that when the footpad 16 is in a resting position (see FIG. 3), the curved arm contacts the top of the brace 36 and when maximally pressed (see FIG. 4), the curved arm contacts the support base 10. In additional embodiments, placement of the brace 36 along the curved arm 18 determines a range of motion of the footpad 16. As a non-limiting example, placing the brace 36 closer to the upper end 44 of the footpad provides a more limited range of motion, which may be more desirable for a user suffering with foot or leg maladies; while placing the bracket at or near the most linear portion of the curved arm maximizes the range of motion.

In supplementary embodiments, the sensor 24 may be a pressure sensor, for example, a force collector configured to detect an amount of pressure applied by the user's foot 32 to the footpad 16. The sensor 26 may be a trigger switch activated each the time user presses the footpad 16 down. In an exemplary embodiment, the footpad 16 may be a pair of footpads that may be independently pressed to engage a respective sensor 24 and sensor 26. The support base 10 may be a sled, which may include a first wall for supporting the footpad 16, the resistance mechanism, and the sensors 24 and 26. The support base 10 may also include a second wall perpendicular to the first wall. The second wall may be substantially flat to support a user's leg(s) as the footpad 16 is engaged. As may be appreciated, the user may thus sit parallel to the floor while exercising the legs against the footpad 16. The user's leg(s) are supported so that the user's foot and legs may exert ample force to the footpad 16 with the support base 10 providing a supporting counterforce to the press of the foot/leg. In some embodiments, the support base 10 may include slots 12 and straps 14 received through the slots 12. The straps 14 may be used to secure the device to a supporting surface 34 (for example a bed).

Figure 5:
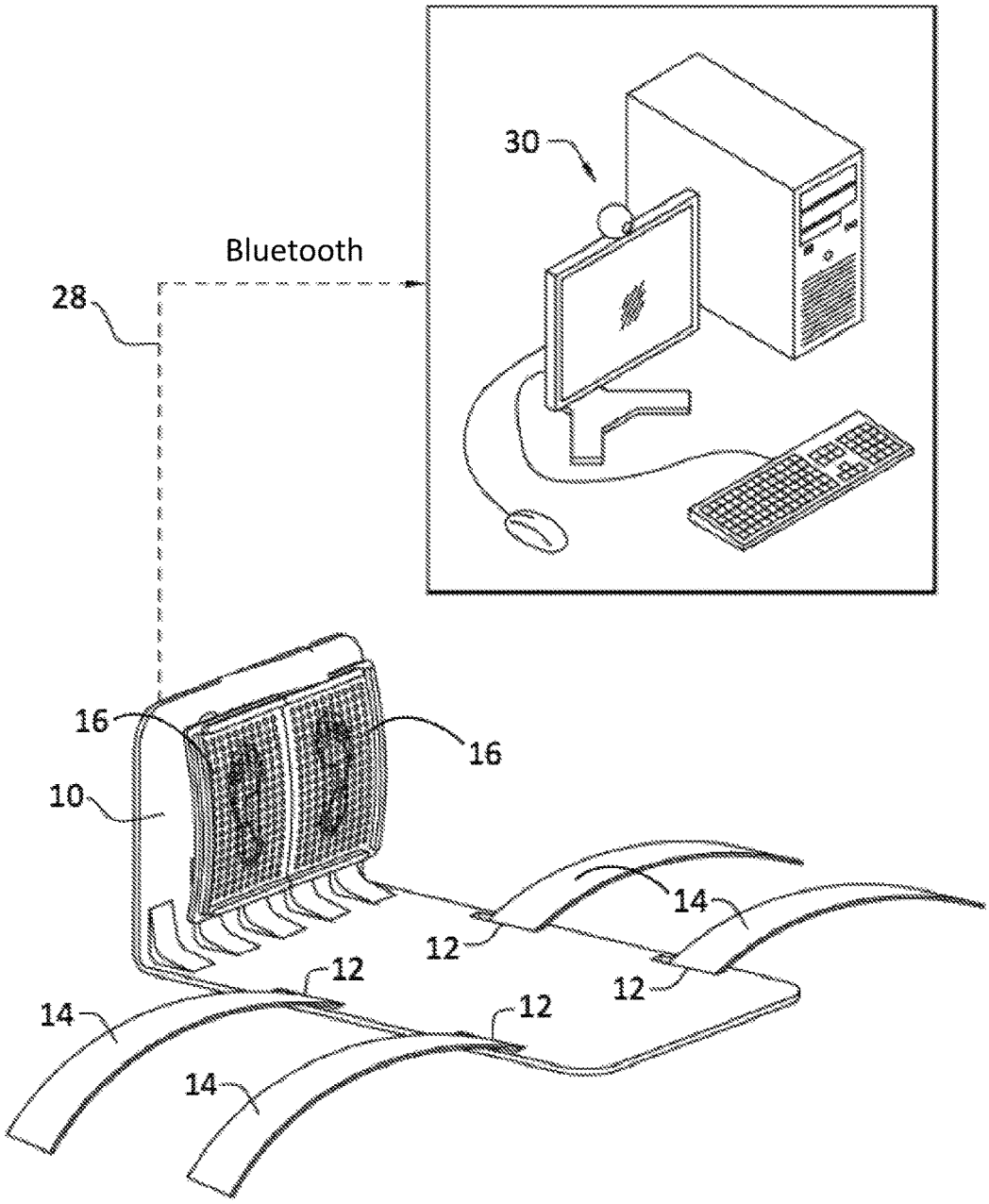
FIG. 5 is a schematic view of a system using the device of FIG. 1.
Figure 6:
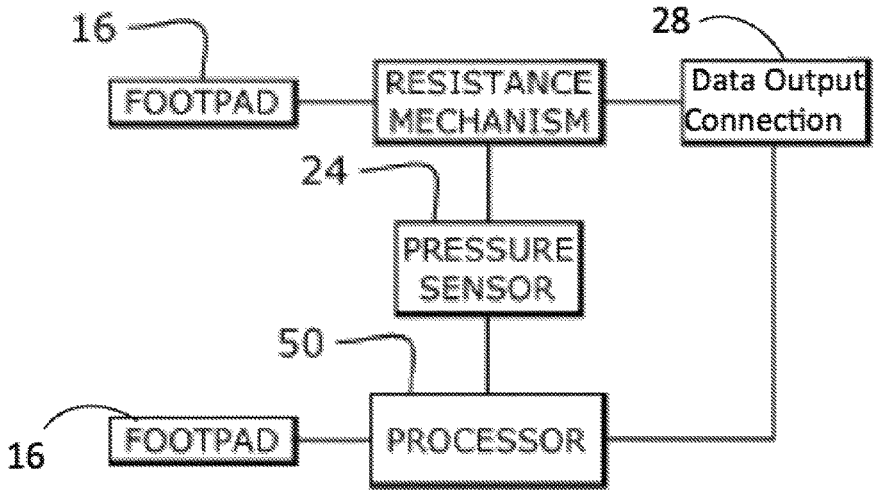
FIG. 6 is a block diagram of the system of FIG. 1 in accordance with an exemplary embodiment of the subject technology.

Referring now to FIG. 5 and FIG. 6, the device may include a data output module comprising a data output connection 28 that can connect the sensors 24,26 to an external general computing device 30. The data output module may further comprise a wireless transmitter that uses, for example, a Bluetooth® connection. A processor 50 may collect the data from the sensors 24 and 26 and provide the data for evaluation. For example, in operation, the device may detect the amount of pressure applied by the user and the number of repetitions pressed by the user in a strength training session. The data gathered by the sensors 24 and 26 may be stored and/or transmitted from the processing unit 50 through the data output connection 28 to the external computing device 30 for display. Some embodiments may display to the user the performance as a whole from a session, the performance of each side (right and left foot/leg 32), and comparisons to previous sessions. Moreover, software packaged with the device may include scenery for display on the external computing device to provide motivation and incentive to engage in use of the device. Thus, progress and visual feedback provide the user with motivational visual incentives to continue strengthening the legs with the goal of preventing deep vein thrombosis and improving de-conditioned muscles.

Persons of ordinary skill in the art may appreciate that numerous design configurations may be possible to enjoy the functional benefits of the inventive systems. Thus, given the wide variety of configurations and arrangements of embodiments of the present invention the scope of the present invention is reflected by the breadth of the claims below rather than narrowed by the embodiments described above.

What is claimed is:

1. A device for movement and resistance training of a lower extremity, said device being capable of electronically tracking use and level of resistance for a user, said device comprising:

(a) a support base (10);

(b) a footpad (16), having an upper end (44) and a lower end (46), attached to the support base (10), wherein the footpad (16) has a curved shape to ensure full contact between a foot (32) of the user and the footpad (16) thus allowing the foot (32) of the user to apply an equal distribution of pressure to the footpad (16), wherein the curved shape of the footpad (16) is convex from the upper end (44) of the footpad (16) to the lower end (46) of the footpad (16);

(c) a resistance mechanism, attached to the footpad (16), to resist pressure applied by the foot (32) of the user to the footpad (16), wherein the resistance mechanism comprises:

(i) a curved arm (18) having a first end and a second end, wherein the first end is attached near the upper end (44) of the footpad (16), and wherein the curved arm (18) curves toward the lower end (46) of the footpad (16);

(ii) a spring hinge mounted to a bracket (22) secured to the support base (10), wherein the second end of the curved arm is attached to the bracket (22) via the spring hinge, wherein a resistance of the spring hinge determines a resistance of the footpad (16), wherein the bracket (22) provides a pivot point configured such that the foot (32) of the user moves about pivot point wherein the pivot point is between the upper end (44) and the lower end (46) of the footpad (16); and (iii) a brace (36) directly coupling the curved arm (18) to the support base (10), wherein a placement of the brace along the curved arm (18) determines a range of motion of the footpad (16), wherein the resistance mechanism provides an equal distribution of resistance to the footpad (16) for a more effective training of the lower extremity; and (d) one or more sensors (24, 26) attached to the footpad (16), wherein the one or more sensors (24,26) are configured to detect an amount of pressure applied by the foot (32) of the user and a number of presses by the foot (32) of the user.

2. The device of claim 1, further comprising a first wall supporting the footpad and a second wall perpendicular to the first wall, the second wall configured to support a leg of the user.

3. The device of claim 1, wherein the first end of the curved arm is disposed between the upper end (44) of the footpad (16) and a middle portion of the footpad (16).

4. The device of claim 1, wherein the curved shape of the footpad (16) is convex or straight from a leftmost border (40) of the footpad (16) to a rightmost border (42) of the footpad (16).

5. The device of claim 1, wherein the one or more sensors includes a pressure sensor.

6. The device of claim 1 further comprising a data output module for providing the amount of pressure applied by the foot (32) of the user and the number of presses by the foot (32) of the user to an external computing device (30) for display, thereby providing motivational visual incentives to the user.

7. The device of claim 6, wherein the data output module includes a wireless transmitter.

8. A device for movement and resistance training of a lower extremity, said device being capable of electronically tracking use and level of resistance for a user, said device comprising:

(a) a support base (10);

(b) a footpad (16), having an upper end (44) and a lower end (46), attached to the support base (10), wherein the footpad (16) has a curved shape to ensure full contact between a foot (32) of the user and the footpad (16) thus allowing the foot (32) of the user to apply an equal distribution of pressure to the footpad (16), wherein the curved shape of the footpad (16) is convex from the upper end (44) of the footpad (16) to the lower end (46) of the footpad (16); and (c) a resistance mechanism, attached to the footpad (16), to resist pressure applied by a foot (32) of the user to the footpad (16), wherein the resistance mechanism comprises:

(i) a curved arm (18) having a first end and a second end, wherein the first end is attached near the upper end (44) of the footpad (16), and wherein the curved arm (18) curves toward the lower end (46) of the footpad (16); and (ii) a spring hinge mounted to a bracket (22) secured to the support base (10), wherein the second end of the curved arm is attached to the bracket (22) via the spring hinge, wherein the bracket (22) provides a pivot point configured such that the foot (32) of the user moves about pivot point, wherein the pivot point is between the upper end (44) and the lower end (46) of the footpad (16);

wherein the resistance mechanism provides an equal distribution of resistance to the footpad (16) for a more effective training of the lower extremity.

9. The device of claim 8, wherein the first end of the curved arm is disposed between the upper end (44) of the footpad (16) and a middle portion of the footpad (16).

10. The device of claim 8 further comprising a brace (36) directly coupling the curved arm (18) to the support base (10), wherein a placement of the brace along the curved arm (18) determines a range of motion of the footpad (16).

11. The device of claim 8, wherein a resistance of the spring hinge determines a resistance of the footpad (16).

12. The device of claim 8 further comprising one or more sensors (24, 26) attached to the footpad (16), the one or more sensors (24,26) configured to detect an amount of pressure applied by the foot (32) of the user and a number of presses by the foot (32) of the user.

13. The device of claim 12, wherein the one or more sensors (24,26) includes a pressure sensor.

14. The device of claim 13 further comprising a data output module for providing the amount of pressure applied by the foot (32) of the user and the number of presses by the foot (32) of the user to an external computing device (30) for display, thereby providing motivational visual incentives to the user.

15. The device of claim 14, wherein the data output module includes a wireless transmitter.

16. The device of claim 8 further comprising a first wall supporting the footpad (16) and a second wall perpendicular to the first wall, the second wall configured to support a leg of the user.

* * * * *